US006193186B1

(12) United States Patent
Kewin

(10) Patent No.: US 6,193,186 B1
(45) Date of Patent: Feb. 27, 2001

(54) TUBULAR CORE ASSEMBLIES FOR ROLLS OF PAPER OR OTHER SHEET MATERIAL

(76) Inventor: Daniel Kewin, 16 Dogwood Dr., Brantford, Ontario (CA), N3R 1R3

( * ) Notice: Subject to any disclaimer, the term of this patent is extended or adjusted under 35 U.S.C. 154(b) by 0 days.

(21) Appl. No.: 09/255,276

(22) Filed: Feb. 23, 1999

(51) Int. Cl.[7] ..... B65H 75/10
(52) U.S. Cl. ..... 242/613.5
(58) Field of Search ..... 242/613.5, 610.4, 242/611.2, 609, 609.1, 609.4

(56) References Cited

U.S. PATENT DOCUMENTS

| | | | | |
|---|---|---|---|---|
| 3,713,601 | * | 1/1973 | Buhrman et al. | 242/613.5 |
| 4,874,139 | * | 10/1989 | Kewin | 242/613.5 |
| 4,875,636 | * | 10/1989 | Kewin | 242/613.5 |
| 5,236,141 | * | 8/1993 | Kewin | 242/613.5 |
| 5,356,093 | * | 10/1994 | Kewin | 242/613.5 |
| 5,393,010 | * | 2/1995 | Renck | 242/613.5 |
| 5,441,780 | * | 8/1995 | Bushell et al. | 242/610.4 |
| 5,595,356 | * | 1/1997 | Kewin | 242/613.5 |
| 5,615,845 | * | 4/1997 | Kewin | 242/613.5 |
| 5,725,178 | * | 3/1998 | Kewin | 242/613.5 |
| 5,829,713 | * | 11/1998 | Kewin | 242/613.5 |

* cited by examiner

*Primary Examiner*—John M. Jillions
(74) *Attorney, Agent, or Firm*—Robert F. Delbridge

(57) ABSTRACT

A tubular core assembly for roll of paper or other sheet material has a hollow cylindrical core member formed of paperboard material and an annular end member of plastic material within each opposite end portion of the core member. Each end member has an outer annular surface secured to the inner annular surface of the core member and an inner surface shaped to receive a roll supporting chuck. Each end member also has at least two radially-projecting lugs at the respective end of the tubular core assembly positioned so as to be rotationally balanced. The core member has at least two lug-receiving notches at each end receiving lugs of the respective end member to rotationally equalize continuous torque and axial chuck pressure from each end member to the core member. Each end member also has an inner annular surface at the end which is continuous and of constant radius around the circumference thereof.

10 Claims, 2 Drawing Sheets

TUBULAR CORE ASSEMBLIES FOR ROLLS OF PAPER OR OTHER SHEET MATERIAL

This invention relates to tubular core assemblies for rolls of paper or other sheet material.

BACKGROUND OF THE INVENTION

Tubular core assemblies which have a hollow cylindrical core member of paper board material and an annular end member of plastic material within each opposite end portion of the core member are known, see for example U.S. Pat. No. 5,236,141 issued Aug. 17, 1993, U.S. Pat. No. 5,595,356 issued Jan. 21, 1997, U.S. Pat. No. 5,615,845 issued Apr. 1, 1997, U.S. Pat. No. 5,725,178 issued Mar. 10, 1998 and U.S. Pat. No. 5,829,713 issued Nov. 3, 1998, the contents of which are hereby incorporated herein by reference.

U.S. Pat. No. 5,615,845 and U.S. Pat. No. 5,829,713 mentioned above are particularly concerned with tubular core assemblies intended for mounting on chucks having radially movable portions which are movable radially outwardly to engage the inner surface of a tubular core assembly and on chucks which are movable under axial pressure into engagement with the ends of the tubular core assembly. Some of the tubular core assemblies described in these two prior patents are also suitable for use with chucks having a single key which engages in a notch in the tubular core assembly.

In the printing industry, paper rolls have until recently usually been mounted on chucks by means of equipment which is manually controlled. However, equipment which automatically mounts paper rolls on chucks without requiring manual control is now being provided in press rooms. When such automated equipment is used, chucks without keys are moved under axial pressure into engagement with the ends of a tubular core assembly, because it is difficult to mount a paper roll on chucks with keys with such automated equipment.

For various reasons, it is advantageous to use with such automated equipment tubular core assemblies which comprise a hollow cylindrical core member of paperboard material with an annular end member of plastic material within each opposite end portion thereof. As described in the previously mentioned prior patents, each annular end member is provided with at least one radially-projecting lug adjacent an end thereof which is engaged in a lug-receiving notch in the core member to facilitate transmission of torque and axial chuck pressure from the end member to the core member. The prior patents also teach that each annular end member should preferably be provided with a pair of notches at diametrically opposite positions for receiving a key of a roll supporting chuck.

When automated equipment is used to mount paper rolls on axially movable chucks without keys in a press room, it has been found to be necessary for the chucks to engage the ends of the tubular core assemblies with very high continuous axial or radial pressure for efficiently transmitting torque thereto, especially when very heavy paper rolls are used, for example paper rolls having a weight when fully wound of about 3,000 lbs. or more.

It has been found that, when tubular core assemblies with end members as described above are subjected to such very high continuous axial or radial pressure, the transmission of such pressure through the annular end members to the core member may cause the core member to become distorted under continuous static and/or dynamic loads. Since the core members of heavy paper rolls may be of considerable length, for example about 5 feet or longer, such distortion may cause serious problems with rolls unwinding at high speed during a printing operation, especially if the rolls are slightly out of round.

It is therefore an object of the invention to provide a tubular core assembly comprising a core member with annular end members which is more suitable for use with automated roll mounting equipment.

SUMMARY OF INVENTION

The present invention is based on the discovery that the problem mentioned above is substantially reduced if each plastic annular end member has at least two radially projecting lugs adjacent an end thereof positioned so as to be rotatably balanced, i.e. equi-angularly spaced around the end member, and also has an inner annular surface at said end which is continuous and of constant radius around the circumference thereof, thereby maximizing the cylindrical hoop strength of the annular end member.

The annular end member may have a pair of radially-projecting lugs which are diametrically opposite, or may have three radially-projecting lugs angularly spaced at 120° intervals, or may have four radially-projecting lugs angularly spaced at 90° intervals.

DESCRIPTION OF THE DRAWINGS

Embodiments of the invention will now be described, by way of example, with reference to the accompanying drawings, of which.

DESCRIPTION OF PREFERRED EMBODIMENTS

Figure 1:
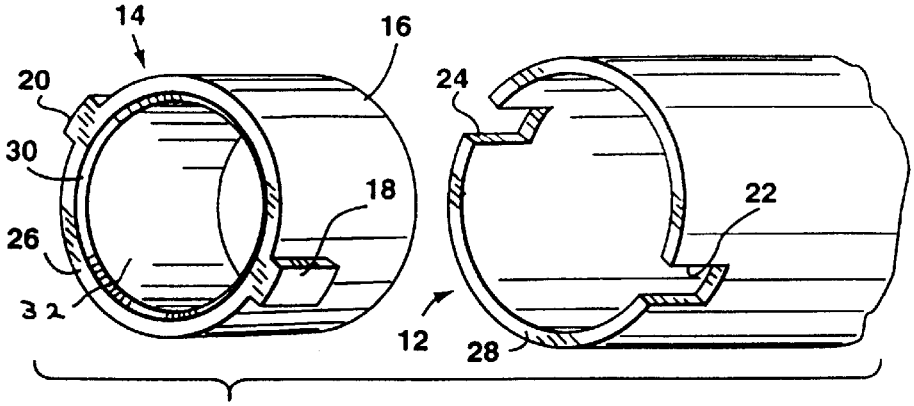
FIG. 1 is an exploded view of one end portion of a tubular core assembly in accordance with one embodiment of the invention.
Figure 2:
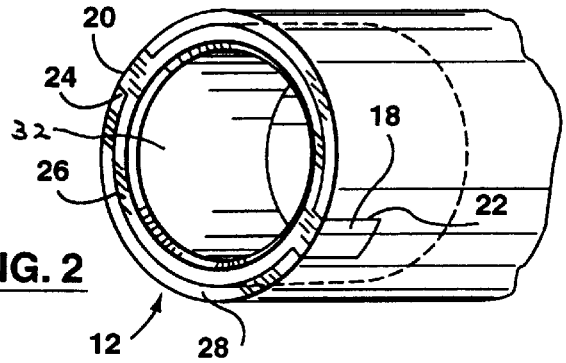
FIG. 2 is a perspective view of the tubular core assembly of FIG. 1 in an assembled condition.

Referring to the drawings, FIGS. 1 and 2 show one end portion of a tubular core assembly for a paper roll which comprises a hollow cylindrical core member 12 of paperboard material, and an annular end member 14 of synthetic plastic material with a sleeve portion 16 within each opposite end portion of the core member 12. The core member 12 has multiple spirally-wound wraps (i.e. laminated plies) of paperboard material, and the synthetic plastic material may be of suitable polymeric material such as injection moulding grade 25% glass filled nylon type 6.

The sleeve portion 16 of each end member 14 has an outer annular surface which is a compression fit, i.e. a friction fit, in a respective end portion of the core member 12. Each end member 14 has a pair of diametrically opposite solid lugs 18, 20 of rectangular section projecting radially outwardly from the end of the sleeve portion 16 at the end of the core member 12. The lugs 18, 20 are located in diametrically opposite notches 22, 24 of rectangular section in the end of the core member 12, and rotationally equalize continuous torque and axial pressure from the end members 14 to the core member 12. The lugs 18, 20 are the same size as the notches 22, 24 so as to be a close fit therein.

Each end member 14 also has an end surface 26 adjacent the respective end 28 of the core member 12, and the end surface 26 has a radially inwardly and rearwardly bevelled radially inner portion 30 for engagement by a chuck (not shown) inserted into the end member 16.

Each end member 14 has an internal diameter in the range of about 3 to about 6 inches, an outer diameter in the range of from about 3.25 to about 7 inches and a length in the range of from about 1.5 to about 6 inches. The core member 12 has an outer diameter in the range of from about 4 to about 9 inches and a length in the range of from about 2 to about 10 feet. The ratio of end member roll thickness to core member thickness is in the range of from about 0.75:1 to about 1.5:1.

The lugs 18, 20 each have a height above the outer annular surface of the end member 14 in the range of from about 0.2 to about 1 inch, a circumferential width in the range of from about 0.25 to about 3 inches, and an axial length in the range of from about 0.5 to about 4 inches. The notches 22,24 are of course similarly sized.

In a specific example of the invention, the sleeve member 16 of each end member 14 has an internal diameter of 3 inches, an external diameter of 3.75 inches and a length of 3 inches. The core member 12 has an outer diameter of 4.4 inches and a length of 4.5 ft, and the ratio of end member roll thickness to core member thickness is 1.15:1. Each lug 18, 20 has a height above the outer annular surface of the end member 14 of 0.325 inches, a circumferential width of 0.75 inches, and an axial length of 0.75 inches. The notches 22, 24 are of course of substantially the same size.

Each end member 14 has no notches and thus has an inner surface 32 extending throughout the length of the annular member 14 which is continuous and of constant radius around the circumference thereof, thereby reducing the likelihood of distortion of the end member 14 and consequent distortion of the core member 12 when the tubular core assembly is used with a heavy paper roll. It is also advantageous that each lug 18, 20 is solid.

Figure 3:
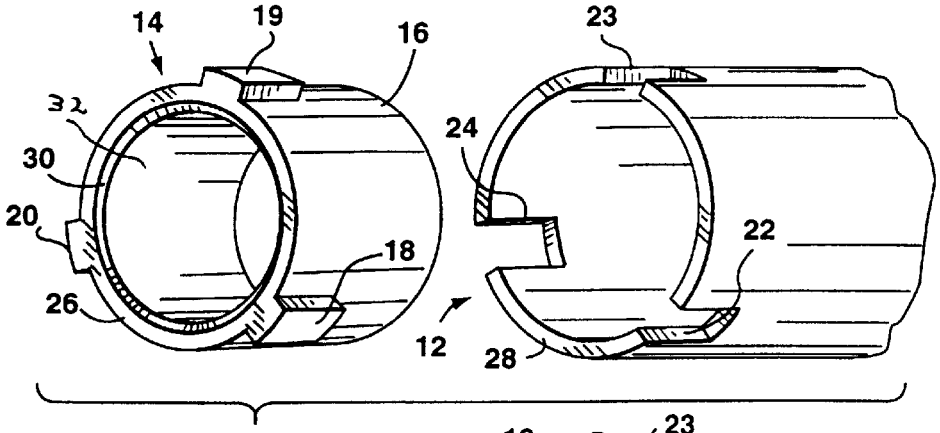
FIG. 3 is an exploded view of one end portion of a tubular core assembly in accordance with a second embodiment.
Figure 4:
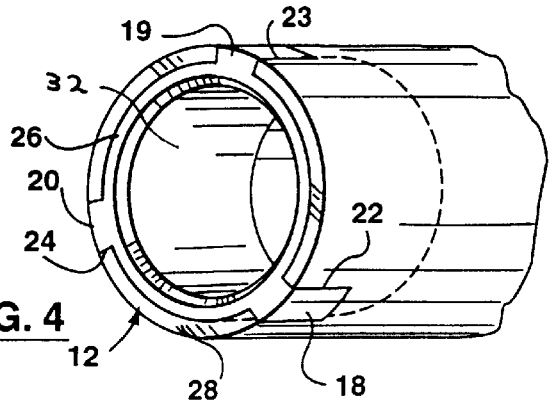
FIG. 4 is a perspective view of the tubular core assembly of FIG. 3 in an assembled condition.

FIGS. 3 and 4 show a further embodiment which is generally similar to the embodiment shown in FIGS. 1 and 2, except that each end member 14 has three solid lugs 18,19,20 spaced at 120° intervals around the end member and the core member 12 has three similarly located notches 22, 23, 24.

Figure 5:
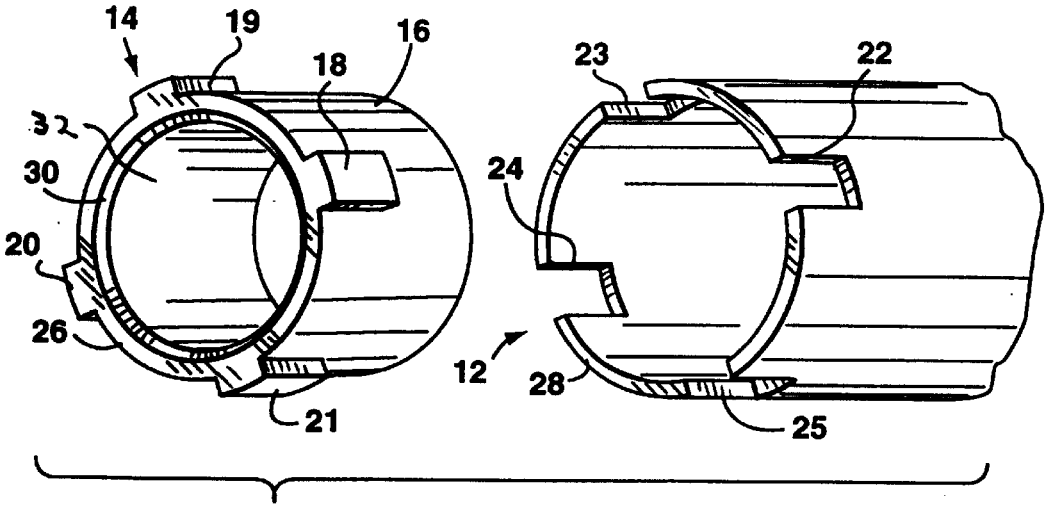
FIG. 5 is an exploded view of one end portion of a tubular core assembly in accordance with a third embodiment.
Figure 6:
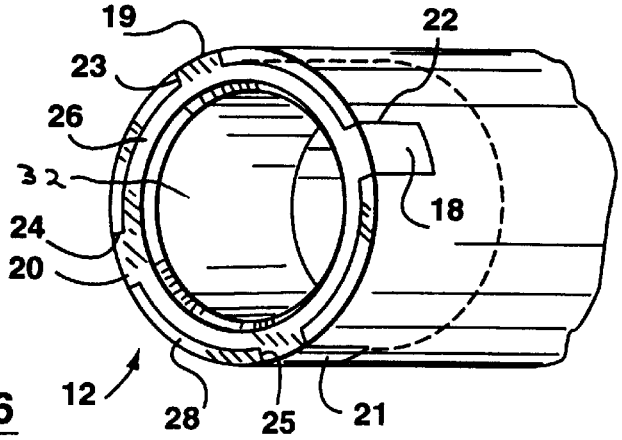
FIG. 6 is a perspective view of the tubular core assembly of FIG. 5 in an assembled condition.

FIGS. 5 and 6 show a further embodiment which is generally similar to the previous embodiments, except that the end member 14 has four lugs 18, 19, 20, 21 spaced at 90° intervals around the end member 14 and the core member 12 has four similarly positioned notches 22, 23, 24, 25.

Other embodiments of the invention will be readily apparent to a person skilled in the art, the scope of the invention being defined in the appended claims.

What is claimed is:

1. A tubular core assembly for roll of paper or other sheet material having:

a hollow cylindrical core member formed of paperboard material, and an annular end member of plastic material within each opposite end portion of the core member, each end member having an outer annular surface secured to the inner annular surface of the core member and an inner surface shaped to receive a roll supporting chuck, each end member having at least two radially-projecting lugs at the respective end of the tubular core assembly positioned so as to be rotationally balanced, said core member having at least two lug-receiving notches at each end receiving said lugs of the respective end member to rotationally equalize continuous torque and axial chuck pressure from each end member to the core member, and each end member having an inner annular surface at said end which is continuous and of constant radius around the circumference thereof.

2. A tubular core assembly according to claim 1 wherein the annular end member has two diametrically opposite radially-projecting lugs and the core member has two diametrically opposite lug-receiving notches.

3. A tubular core assembly according to claim 1 wherein each annular end member has three radially-projecting lugs at 120° intervals around the end member and the core member has three similarly positioned lug-receiving notches.

4. A tubular core assembly according to claim 1 wherein each annular member has four radially-projecting lugs at 90° intervals around the end member and the core has 4 similarly positioned lug-receiving notches.

5. A tubular core assembly according to claim 1 wherein each end member has an internal diameter in the range of from about 3 to about 6 inches, an outer diameter in the range of from about 3.25 to about 7 inches and a length in the range of from about 1.5 to about 6 inches, and each lug is solid and has a height above the outer annular surface of the end member in the range of from about 0.2 to about 1 inch, a circumferential width in the range of from about 0.25 to about 3 inches, and an axial length in the range of from about 0.5 to about 4 inches.

6. An annular end member of plastic material for insertion into an end portion of a hollow cylindrical core member of a tubular core assembly for roll of paper or other sheet material, said end member having an outer annular surface securable to an inner annular surface of a core member and an inner annular surface shaped to receive a roll supporting chuck, at least two radially-projecting lugs adjacent an end thereof positioned so as to be rotatably balanced and engageable in lug-receiving notches in a core member, and an inner annular surface at said end which is continuous and of constant radius around the circumference thereof.

7. An annular end member according to claim 6 having two diametrically opposite radially-projecting lugs.

8. An annular end member according to claim 6 having three radially-projecting lugs at 120° intervals.

9. An annular end member according to claim 6 having four radially-projecting lugs at 90° intervals.

10. An annular end member according to claim 6 having an internal diameter in the range of from about 3 to about 6 inches, an outer diameter in the range of from about 3.25 to about 7 inches and a length in the range of from about 1.5 to about 6 inches, each lug being solid and having a height above the outer annular surface in the range of from about 0.2 to about 1 inch, a circumferential width in the range of from about 0.25 to about 3 inches, and an axial length in the range of from about 0.5 to about 4 inches.

* * * * *